US007106280B2

(12) United States Patent
Jeong

(10) Patent No.: US 7,106,280 B2
(45) Date of Patent: Sep. 12, 2006

(54) PLASMA DISPLAY PANEL AND A METHOD FOR DRIVING THE SAME

(75) Inventor: Jin-Hee Jeong, Ahsan (KR)

(73) Assignee: Samsung SDI Co., Ltd., Suwon (KR)

( * ) Notice: Subject to any disclaimer, the term of this patent is extended or adjusted under 35 U.S.C. 154(b) by 168 days.

(21) Appl. No.: 10/384,720

(22) Filed: Mar. 11, 2003

(65) Prior Publication Data

US 2003/0174102 A1 Sep. 18, 2003

(30) Foreign Application Priority Data

Mar. 12, 2002 (KR) ..... 10-2002-0013219

(51) Int. Cl.
*G09G 3/28* (2006.01)

(52) U.S. Cl. ..... 345/68; 345/60

(58) Field of Classification Search ..... 345/60–72
See application file for complete search history.

(56) References Cited

U.S. PATENT DOCUMENTS 6,803,888 B1 * 10/2004 Nakamura et al. ..... 345/60
2004/0196216 A1 * 10/2004 Shindo et al. ..... 345/60

FOREIGN PATENT DOCUMENTS

KR 000063087 A 10/2000

* cited by examiner

*Primary Examiner*—Sumati Lefkowitz
*Assistant Examiner*—Ke Xiao
(74) *Attorney, Agent, or Firm*—H.C. Park & Associates, PLC

(57) ABSTRACT

A PDP and driving method improve the contrast of an AC PDP by maintaining stable discharge and preventing over-discharging in a low gray state by enhancing voltage control of the scan electrodes and sustain electrodes during initialization control. A PDP driving method includes a step of maintaining the first electrode, after applying a rising ramp voltage up to a first voltage level, to a second voltage level that is lower than the first voltage level. A voltage of a third voltage level is applied to the second electrode while maintaining the first electrode at the second voltage level, where the third voltage level is lower than the second voltage level. A falling ramp voltage is applied to the first electrode after maintaining the first electrode at the second voltage level.

20 Claims, 8 Drawing Sheets

PLASMA DISPLAY PANEL AND A METHOD FOR DRIVING THE SAME

FIELD OF THE INVENTION

The present invention relates to a Plasma Display Panel (PDP) and a driving method thereof. More particularly, the present invention relates to a PDP and its driving method that improves the contrast of an AC PDP, which may be used for a television, a monitor of a computer system, etc., The present invention is directed to preventing over-discharging in a low gray state, where the over-discharging is prevented by enhancing voltage control of scan electrodes and sustain electrodes during an initialization control, and accordingly preventing a self-erasing effect.

BACKGROUND OF THE INVENTION

Plasma Display Panels (PDPs) that display video signals using discharging phenomena may be categorized as DC types (DC PDPs) and AC types (AC PDPs) according to their driving voltages. AC PDPs are getting popular because DC PDPs have a complex structure and have low efficiency and a short life span.

As shown in FIG. 1, a typical AC PDP includes a plurality of layers, and it has spatial merits because it is thin and light and can provide a larger display area than more conventional display devices, such as a CRT.

As shown in FIG. 1, the principal structure of an AC PDP includes scan electrodes 4, sustain electrodes 5, a dielectric layer 2, a protecting layer 3, and an insulating layer 7, all of which are arranged between a first glass substrate 1 at an uppermost location and a second glass substrate 6 at a lowermost location. Discharge cells 12 are located on the first glass substrate 1.

The pair of a scan electrode 4 and a sustain electrode 5 between the first glass substrate 1 and the dielectric layer 2 are aligned vertically and parallel with each other. Address electrodes 8 covered with the insulating layer 7 are aligned laterally on the second glass substrate 6 and are approximately perpendicular to the scan electrodes 4 and the sustain electrodes 5. A discharge cell 12 is formed, as a discharging area, at a location where one address electrode 8 meets the scan electrode 4 and the sustain electrode 5. Barrier ribs 9 are formed parallel to the address electrodes 8 on the insulating layer 7. In addition, phosphor 10 is formed on the surface of the insulating layer 7 and on both sides of the barrier ribs 9.

Therefore, as shown in FIG. 2, the discharge cells 12 are arranged in a matrix pattern according to the scan electrodes 4, sustain electrodes 5, and the address electrodes 8.

Improving contrast, among a variety of features, takes an important role in improving the display quality of a PDP having such a structure. The contrast of an image displayed on the PDP is expressed as a ratio of luminance at the state of no discharging, which is darkest, to a luminance at the peak white state, which is brightest. The light in the peak white state is achieved mainly by a sustain discharge, and the darkest portion is when there is no sustain discharge. However, every cell goes through discharge in the initializing step.

Therefore, improvement of the contrast may be achieved by enhancing the brightness of the brightest portion or by reducing the brightness of the darkest portion. The contrast is also improved if a background luminance in the state of no discharging is lowered.

One field of a signal for driving such an AC PDP usually includes 8 to 12 subfields, where each subfield may be divided into 4 periods of a reset period, an address period, a sustain period, and an erase period.

The address period is a period where actual data is applied. During the address period, cells to be activated are selected and wall charges are accumulated in the selected cells. The reset period is a period for initializing each cell before the address period to ensure application of data in the address period.

The sustain period is a period where discharge takes place in order to actually display a video signal at the cells addressed in the address period. In the erase period, the sustain discharge is terminated by reducing the wall charges of the cells.

FIG. 3 shows a conventional pattern of driving signals for a PDP according to the prior art.

As shown in FIG. 3, the sustain electrode X is kept at its ground voltage in the reset period while a signal applied to the scan electrode Y is increased linearly in a rising ramp period.

At this time, a weak discharge takes place between the address electrode A and the scan electrode Y. As a result, positive wall charges are accumulated at the address electrode A and negative wall charges are accumulated at the scan electrode Y. A small amount of positive charge is also accumulated at the sustain electrode X because the sustain electrode is maintained at its ground voltage.

An initialization discharge that occurs during the rising ramp period is hereinafter described in detail.

During the rising ramp period, a weak discharge between the address electrode A and the scan electrode Y becomes a primary discharge. As a result, positive charges are accumulated at the address electrode A and the sustain electrode X, and negative charges are accumulated at the scan electrode Y.

The sustain electrode X functions as a cathode in the discharge among the address electrode A, the sustain electrode X, and the scan electrode Y, because the sustain electrode X is also maintained at its ground voltage. Therefore, the sustain electrode X also gathers positive charges.

During a falling ramp period that follows the rising ramp period, the positive charges of the address electrode A are maintained, and the positive charges of the sustain electrode X are eliminated by a discharge between the sustain electrode X and the scan electrode Y. During this falling ramp period, negative charges accumulated at the scan electrode Y are in part transferred to the sustain electrode X.

For an AC PDP having 12 subfields, the total luminance in such a reset period is approximately 1.0 to 1.2 cd/m$^2$. Therefore, supposing that the luminance at the brightest state is 500 cd, a contrast ratio in a darkroom would be approximately 420:1 to 500:1, which is low.

In addition, during the reset period, a voltage of 0 (zero) volts is applied to the address electrode A regardless of the color of the phosphor.

FIG. 4 illustrates the driving signals of FIG. 3 for the scan electrode Y and the sustain electrode X together in the same plane during the reset period.

As shown in FIG. 4, the driving voltage Vx applied to the sustain electrode X maintains its ground voltage of 0 (zero) volts while the driving voltage Vy applied to the scan electrode Y remains in a rising ramp period (refer to region a).

At the moment that the driving voltage Vy applied to the scan electrode Y is lowered to a voltage Vs, the driving voltage Vx applied to the sustain electrode X is increased to a voltage Ve. In an intermediate region b, the driving voltage Vx, of the sustain electrode X is maintained to be higher than the driving voltage Vy of the scan electrode Y.

After the intermediate region b, the driving voltage Vy applied to the scan electrode Y is reduced from the voltage Vs to the ground voltage following a pattern of a falling ramp.

FIG. 5 illustrates charges accumulated at each of the electrodes according to regions of the reset period shown in FIG. 4.

In a stage S100 that corresponds to the region a in FIG. 4, the voltage of the scan electrode Y rises up to 380 V following a ramp pattern, and the sustain electrode X and the address electrode A are maintained at their ground voltages.

At this time, a weak discharge occurring between the address electrode A and the scan electrode Y becomes a primary discharge. As a result, positive charges are accumulated at the address electrode A and the sustain electrode X, and negative charges are accumulated at the scan electrode Y.

The sustain electrode X functions as a cathode in the discharge among the address electrode A, the sustain electrode X, and the scan electrode Y, because the sustain electrode X is also maintained at its ground voltage. Therefore, the sustain electrode X also gathers positive charges.

Stage S110 shows a state immediately after entering the region b. At this time, the driving voltage for the sustain electrode X is, for example, 195V, and the driving voltage for the scan electrode Y is reduced, for example, to 165V.

The illustration for the stage S120 shows distribution and movement of wall charges in the region b.

In the region b, the driving voltage Vx applied to the sustain electrode X is increased to a voltage Ve at the moment that the driving voltage Vy applied to the scan electrode Y is lowered to a voltage Vs. Subsequently, the voltage of the scan electrode Y is maintained to be lower than the voltage of the sustain voltage.

At the start of the region b, negative wall charges are accumulated at the scan electrode Y since this is immediately after the rising ramp period of the driving voltage, and positive wall charges are accumulated at the sustain electrode X (refer to S110).

Therefore, applying a voltage to the sustain electrode X that is higher than that applied to the scan electrode Y causes an offset of the positive charges at the sustain electrode X and the negative charges of the scan electrode Y, and as a result, generating self-erasing light.

With such a self-erasing light, wall charge distribution of the sustain electrode X and scan electrode Y becomes opposite to that of the moment when starting the region b. In this situation, a mal-discharge may occur because a sustain discharge may be induced when an address signal is not yet applied.

While such a mal-discharge is occurring, positive charges are accumulated at the scan electrode Y and negative charges are accumulated at the sustain electrode X, which may result in failure of an address discharge and an occurrence of mal-discharge in the sustain period before the address period.

In addition, according to the prior art described above, in the case that such a self-erasing light occurs, an over-discharge may occur in a low gray state wherein the number of discharging subfields is small, and accordingly, the contrast of display becomes unstable.

SUMMARY OF THE INVENTION

Therefore, the present invention has been made in an effort to address the above disadvantages.

The present invention is directed to a plasma display panel and its driving method that can improve the contrast by reducing or preventing self-erasing light that may be produced in an intermediate period between a rising ramp period and a falling ramp period of a driving voltage applied to a scan electrode during a reset period.

An exemplary method for driving a PDP during a reset period useful with the present invention, where the PDP includes a pair of a first electrode and a second electrode formed in parallel on a first substrate, and an address electrode formed on a second substrate perpendicularly to the pair of the first electrode and the second electrode, includes maintaining the first electrode, after applying a rising ramp voltage up to a first voltage level, at a second voltage level that is lower than the first voltage level. A voltage of a third voltage level is applied to the second electrode while maintaining the first electrode at the second voltage level, where the third voltage level is lower than the second voltage level. A falling ramp voltage is applied to the first electrode after the maintaining of the first electrode at the second voltage.

In other embodiments, the third voltage level may be lower than the second voltage level by a difference between a wall potential and a discharge triggering voltage.

In a yet other embodiments, the wall potential may be the difference between the first voltage level and the discharge triggering voltage.

In another further embodiment, the method for driving a PDP during a reset period further includes, during the application of the falling ramp voltage to the first electrode, raising the voltage applied to the second electrode according to a rising ramp up to the fourth voltage level, and subsequently maintaining the raised voltage.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will hereinafter be described in detail with reference to the accompanying drawings.

Figure 6:
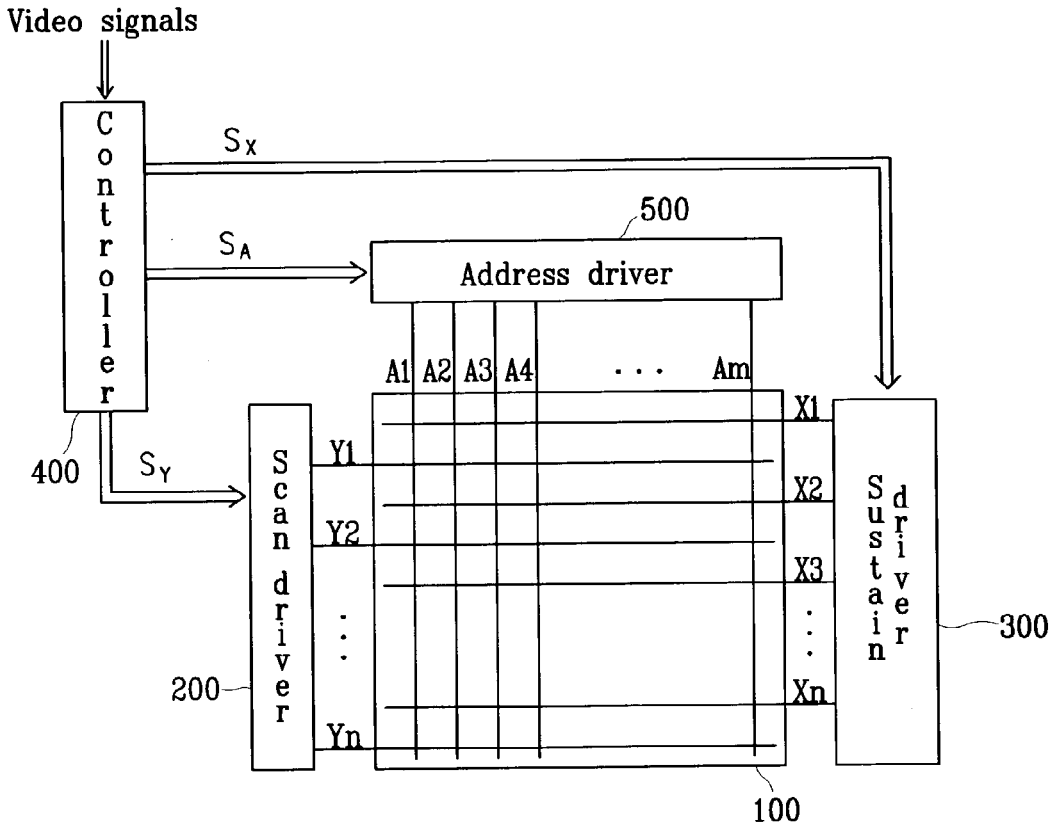
FIG. 6 is a block diagram of a PDP according to a first preferred embodiment of the present invention.

As shown in FIG. 6, a PDP according to a first preferred embodiment of the present invention includes a plasma panel 100, a controller 400, a scan driver 200, a sustain driver 300, and an address driver 500.

The plasma panel 100 includes a multitude of address electrodes A1–Am that are aligned in the column direction, and scan electrodes Y1–Yn and sustain electrodes X1–Xn that are alternately aligned in the row direction.

Operation of a PDP structured as described above according to the first preferred embodiment of the present invention is hereinafter described.

The controller 400 receives video signals from an outside source, generates an addressing signal $S_A$, a scanning signal $S_Y$, and a sustaining signal $S_X$, and then transmits the signals respectively to the address driver 500, the scan driver 200, and the sustain driver 300.

The address driver 500 receives addressing signals from the controller 400, and then applies a data signal to the respective address electrodes in order to select discharge cells.

The scan driver 200 and the sustain driver 300 respectively receive the scanning signal $S_Y$ and the sustaining signal $S_X$ from the controller 400, and then alternately input a sustain triggering voltage to the scan electrode and the sustain electrode. In this way a sustain discharge starts at selected cells.

Figure 7:
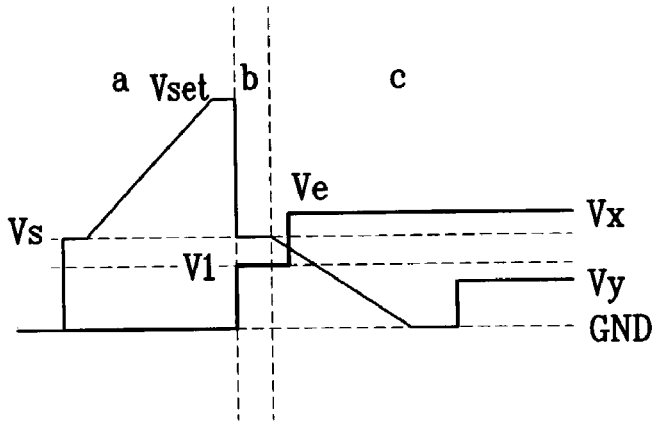
FIG. 7 illustrates driving signals of a PDP driving method according to a first preferred embodiment of the present invention.

FIG. 7 illustrates driving signals during a reset period. In region a, the scan driver 200 applies a rising ramp voltage signal to the scan electrode Y that rises from a scan base voltage Vs up to a predetermined reset voltage Vset. Subsequently, in a region b, the scan driver 200 applies an intermediate driving signal of the scan base voltage Vs to the scan electrode Y. Finally, the scan driver 200 applies a falling ramp voltage signal to the scan electrode Y that falls from the scan base voltage Vs down to the ground voltage.

The sustain driver 300 maintains the sustain electrode X at the ground voltage during the period of the rising ramp signal of the scan driver 200. Subsequently, in the region b for application of the intermediate driving signal to the scan electrode Y, the sustain driver 300 applies a driving signal of a first voltage V1 that is less than the scan base voltage Vs, to the sustain electrode X.

The sustain driver 300 applies a driving signal of a voltage Ve that is higher than the scan base voltage Vs during the application of the falling ramp voltage of the scan driver 200.

As shown above, in the region b, by maintaining the first voltage V1 applied to the sustain electrode X lower than the scan base voltage Vs applied to the scan electrode Y, the potential difference between the scan electrode Y and the sustain electrode X is low enough such that a discharge therebetween is prevented.

Having reset the PDP as described above, the address driver 500 selectively applies corresponding voltage signals to cells that are to be addressed among all the cells. The pattern of driving signals after the reset period is the same as shown in FIG. 3.

After finishing the address step the address driver 500 maintains ground voltage of the address electrodes. The scan driver 200 and the sustain driver 300, as shown in the sustain period in FIG. 3, respectively and alternately apply voltages to the scan electrode and the sustain electrode, which results in maintaining the discharge of cells addressed to discharge during the address period.

Figure 1:
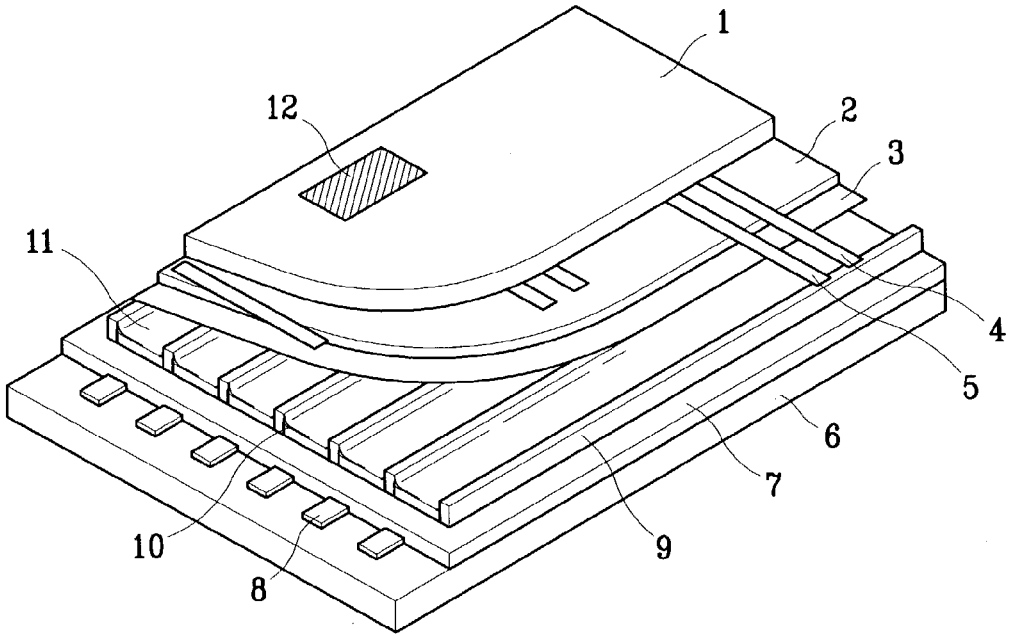
FIG. 1 is a partially cutaway view in perspective of a panel used for an AC PDP.
Figure 2:
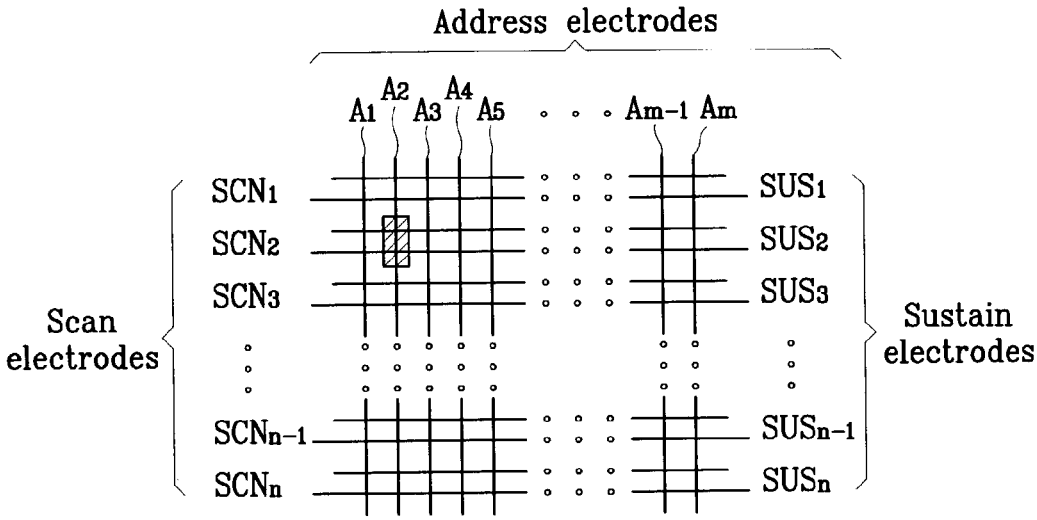
FIG. 2 is a drawing for showing an electrode arrangement of an AC PDP.
Figure 3:
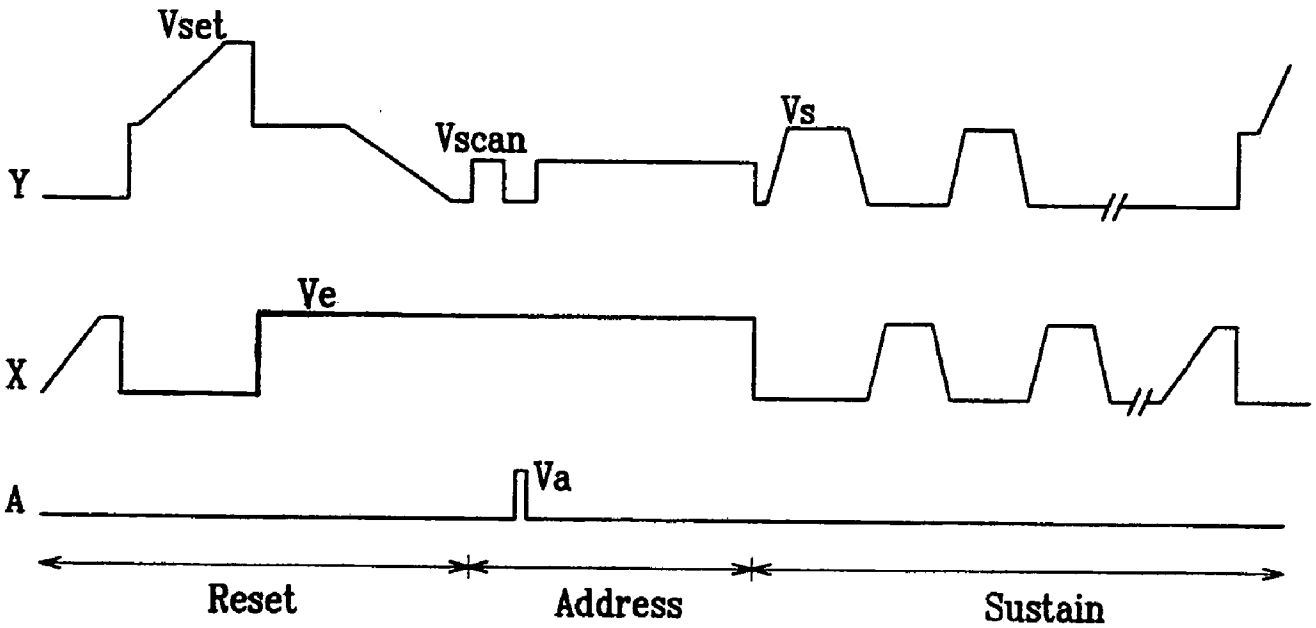
FIG. 3 shows an exemplary pattern of driving signals for a conventional PDP.
Figure 4:
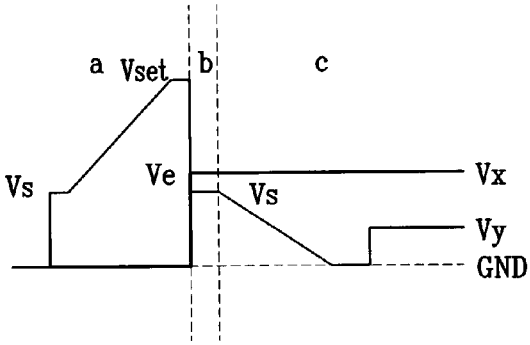
FIG. 4 illustrates the driving signals of FIG. 3 for the scan electrode and the sustain electrode together in the same plane during the reset period.
Figure 5:
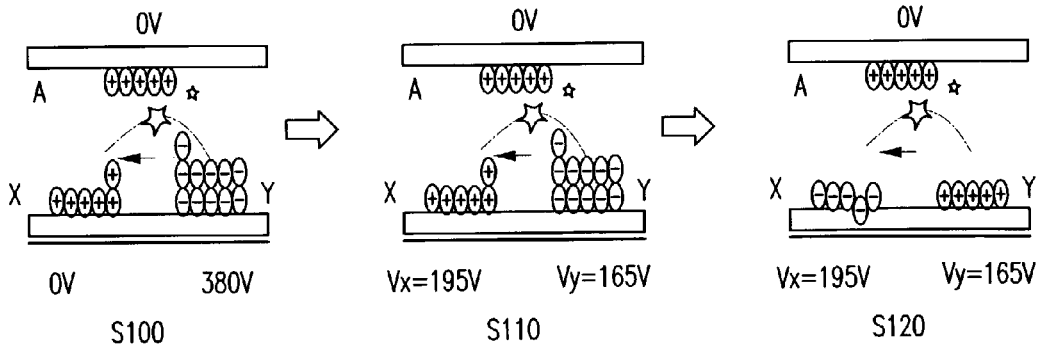
FIG. 5 illustrates charges accumulated at each of the electrodes according to regions of the reset period shown in FIG. 4.

When sustaining of the discharge is to be finished, as shown in FIG. 3, the sustain driver 300 applies an erasing signal to the sustain electrode at a point near the end of the sustain period.

Subsequently, the controller 400 starts a new reset control in order to realize a subsequent subfield. During this new reset control, the sustain driver 300 applies, to the sustain electrode X, a driving signal of a voltage that is lower than the voltage applied by the scan driver 200 in the same way as described above.

Figure 8:
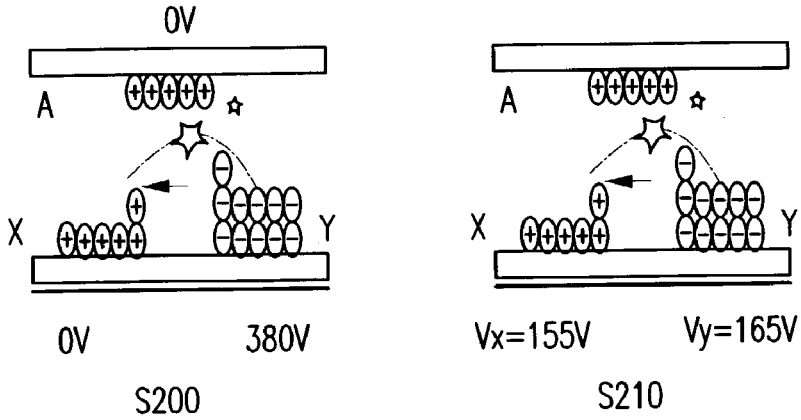
FIG. 8 illustrates charge distribution according to a PDP driving method of a first preferred embodiment of the present invention.

FIG. 8 illustrates the charge distribution according to a PDP driving method of a first preferred embodiment of the present invention.

In stage S200, corresponding to the region a, positive charges are accumulated at the sustain electrode X and negative charges are accumulated at the scan electrode Y.

In stage S210, corresponding to the region b, self-erasing light is not produced and therefore mal-discharge is prevented because the voltage Vx applied to the sustain electrode X is lower than the voltage Vy applied to the scan electrode Y.

Preferable ranges of the voltages Vx and Vy will now be described in detail.

When a ramp rising period of the driving voltage for the scan electrode Y is finished, a wall potential Vwall is formed between the scan electrode Y and the sustain electrode X corresponding to a difference between the predetermined reset voltage and the discharge triggering voltage Vf.

Therefore, an equation "Vx−Vy+Vwall<Vf" (equation 1) should be satisfied in order to prevent discharge in the region b.

Considering that the wall potential Vwall and the discharge triggering voltage Vf satisfy an equation "Vwall=Vset−Vf" (equation 2), Vx may be lower than Vy in the condition that an equation "Vx−2Vf+Vset<Vy" (equation 3) is satisfied. The equation 3 may be obtained by combining the equation 2 and the equation 1.

For example, when the discharge triggering voltage is 210 V and the predetermined reset voltage is 380V, it is preferable that the voltage applied to the sustain electrode X is lower than the voltage applied to the scan electrode Y by approximately 40 V, in the region b.

According to the first embodiment as described above, the contrast of a PDP may be improved because the output luminance in a low gray state is stably maintained by preventing unnecessary discharges in a reset control during the reset period.

Figure 9:
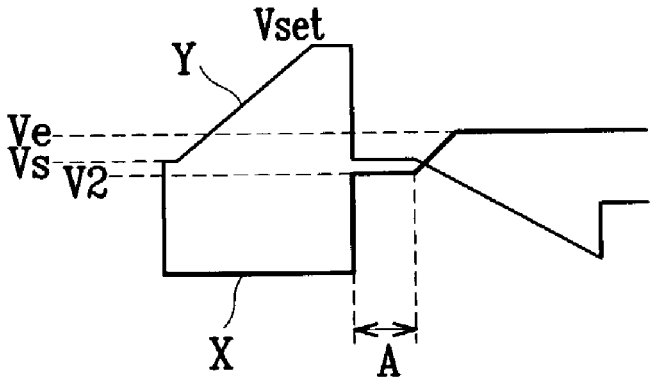
FIG. 9 illustrates driving signals of a PDP driving method according to a second preferred embodiment of the present invention.

Another way of driving signals that are different from those of FIG. 7 is illustrated in FIG. 9.

A second preferred embodiment of the present invention is hereinafter described.

A hardware structure of a PDP according to the second preferred embodiment of the present invention is the same as that according to the first preferred embodiment, and therefore FIG. 6 will be referred to.

Compared with the first preferred embodiment, the second preferred embodiment further adopts a rising ramp control of the sustain driver at an early region during the falling ramp period of the scan driver 200.

During the intermediate driving signal period, as in the first preferred embodiment, the voltage applied to the sustain electrode X is controlled to be lower than the voltage applied to the scan electrode Y.

Operation of the second preferred embodiment of the present invention is hereinafter described with reference to FIG. 6 and FIG. 9.

The controller 400 receives video signals from an outside source, generates an address signal $S_A$, a scanning signal $S_Y$, and a sustaining signal $S_X$, and then transmits the signals respectively to the address driver 500, the scan driver 200, and the sustain driver 300.

The address driver 500 receives addressing signals from the controller 400, and then applies data signals to the respective address electrodes in order to select discharge cells.

The scan driver 200 and the sustain driver 300 respectively receive the scanning signal $S_Y$ and the sustaining signal $S_X$ from the controller 400, and then alternately input a sustain triggering voltage to the scan electrode Y and the sustain electrode X. In this way, a sustain discharge starts at the selected cells.

FIG. 9 illustrates driving signals during a reset period, in detail. Firstly, the scan driver 200 applies a rising ramp voltage signal to the scan electrode Y that rises from a scan base voltage Vs up to a predetermined reset voltage Vset. Subsequently, the scan driver 200 applies an intermediate driving signal of the scan base voltage Vs to the scan electrode Y. Finally, the scan driver 200 applies a falling ramp voltage signal to the scan electrode Y that falls from the scan base voltage Vs down to the ground voltage.

The sustain driver 300 maintains the sustain electrode X at the ground voltage during the period of the rising ramp signal of the scan driver 200. Subsequently, in the region A for application of the intermediate driving signal to the scan electrode Y, the sustain driver 300 applies, to the sustain electrode X, a driving signal of a second voltage V2 that is less than the scan base voltage Vs.

The sustain driver 300 applies a ramp signal rising from the second voltage V2 up to a voltage Ve that is higher than the scan base voltage Vs during the application of the falling ramp voltage of the scan driver 200.

When the voltage applied to the sustain electrode X is raised to the voltage Ve, the sustain electrode X is maintained to the driving signal of the voltage Ve until the end of the reset period. Accordingly, a discharge in the falling ramp period is retarded. Since light generated by the discharge during the Y ramp falling period is retarded, luminance of the black portion is low and the contrast is improved and a stable voltage margin is ensured.

As described above, self-erasing light is prevented and discharge in the falling ramp period is retarded because the second voltage V2 of the positively charged sustain electrode X is lower than the scan base voltage Vs of the scan electrode Y during the region A, and the voltage applied to the sustain electrode X is controlled by a driving signal of a rising ramp during the falling ramp period.

After the reset period, as shown in FIG. 3, an address period, a sustain discharge control period, and an erasing period proceed as in the first preferred embodiment.

When a new reset period starts, application of the ground voltage, application of a low voltage driving signal, and application of a rising ramp driving signal are performed to the sustain electrode respectively in parallel with application of a rising ramp voltage, application of the intermediate driving signal, and application of the falling ramp voltage to the scan electrode.

In the region A, the voltage applied to the sustain electrode X may be set as a second voltage V2 that is lower than the scan base voltage Vs and that can enable the reset function.

In the same way, during the falling ramp period, the rising ramp voltage applied to the sustain electrode X may have the pattern rising from the second voltage V2 to the voltage Ve.

It is preferable that the above-described second voltage V2 is lower than the voltage applied to the scan electrode by a difference between the wall potential and the discharge triggering voltage Vf as explained with reference to equations 1 and 3 above.

Figure 10:
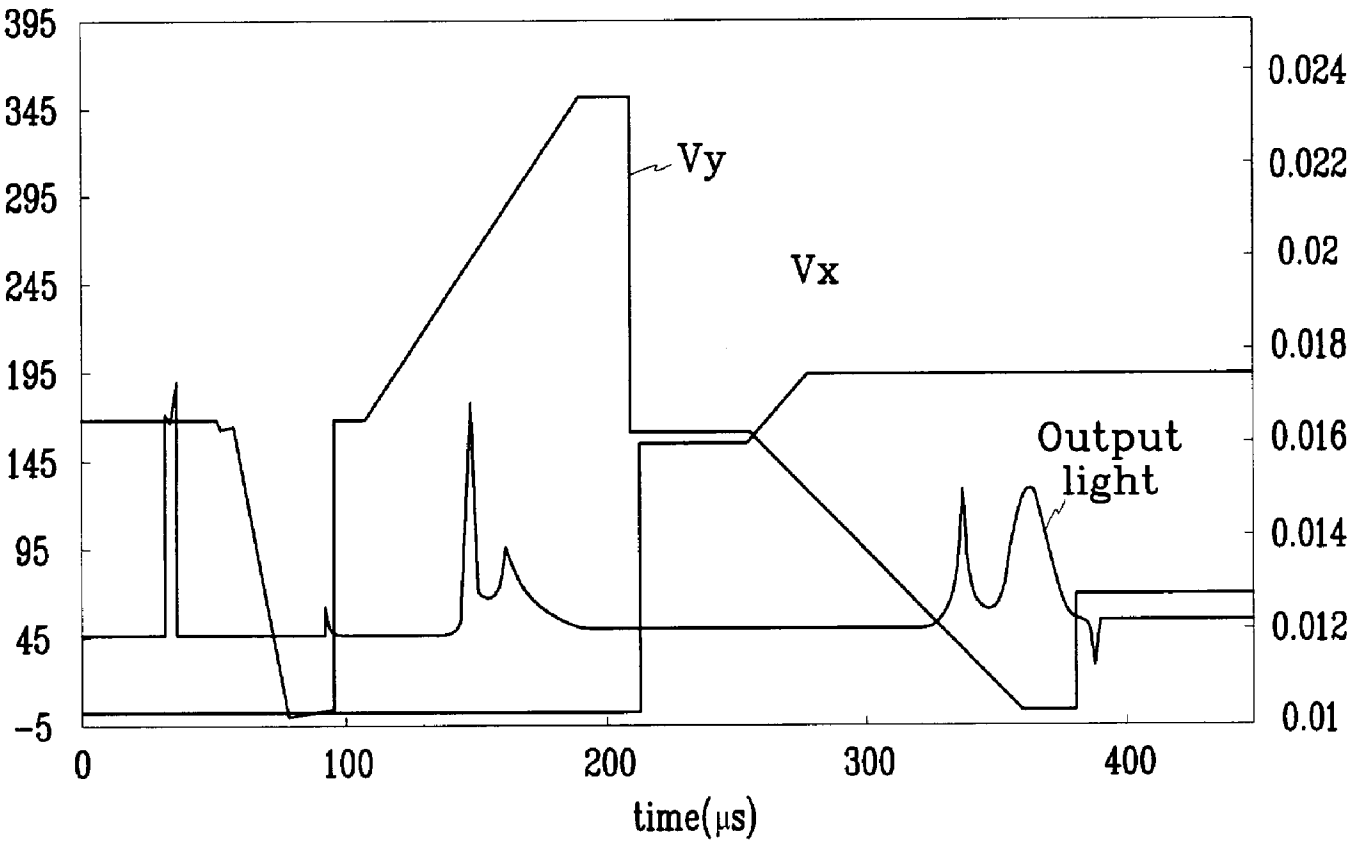
FIG. 10 shows a graph for showing output luminance according to a method for driving a PDP of a second preferred embodiment of the present invention.

FIG. 10 shows a graph for showing output luminance according to a PDP driving method of a second preferred embodiment of the present invention.

As can be seen in FIG. 10, no output luminance is produced during a range of 200–250 μsμs that corresponds to the periods b of FIG. 7 and A of FIG. 9.

As described above, during a reset period of a PDP, a voltage lower than a scan base voltage Vs, such as the first voltage V1 and the second voltage V2, is applied to the sustain electrode X during the period A of applying the intermediate driving signal to the scan electrode Y, A voltage of a rising ramp is applied to the sustain electrode X during the falling ramp region of the voltage applied to the scan electrode Y.

Accordingly, luminance of the black portion is maintained in a low state by stably maintaining the background luminance, and therefore, the contrast is improved and a voltage margin is ensured.

In particular, discharge becomes stable in a low gray state.

According to preferred embodiments of the present invention, stable discharge is enabled and contrast is improved by properly setting the voltage applied to the sustain electrode X in reset control of driving an AC PDP.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A method for driving a PDP during a reset period, the PDP comprising a first electrode and a second electrode formed substantially in parallel on a first substrate, and an address electrode formed on a second substrate substantially perpendicularly to the first electrode and the second electrode, the method comprising steps of:

applying a rising ramp voltage up to a first voltage level to the first electrode and then maintaining the first electrode at a second voltage level that is lower than the first voltage level;

increasing a voltage applied to the second electrode to a third voltage level and then applying the voltage of the third voltage level to the second electrode while maintaining the first electrode at the second voltage level, the third voltage level being lower than the second voltage level; and applying a falling ramp voltage to the first electrode after maintaining the first electrode at the second voltage level.

2. The method of claim 1, wherein the third voltage level is lower than the second voltage level by a difference between a wall potential and a discharge triggering voltage.

3. The method of claim 2, wherein the wall potential is a difference between the first voltage level and the discharge triggering voltage.

4. A method for driving a PDP during a reset period, the PDP comprising a first electrode and a second electrode formed substantially in parallel on a first substrate, and an address electrode formed on a second substrate substantially perpendicularly to the first electrode and the second electrode, the method comprising steps of:

applying a rising ramp voltage up to a first voltage level to the first electrode and then maintaining the first electrode at a second voltage level that is lower than the first voltage level;

applying a voltage of a third voltage level to the second electrode while maintaining the first electrode at the second voltage level, the third voltage level being lower than the second voltage level;

applying a falling ramp voltage to the first electrode after maintaining the first electrode at the second voltage level; and raising the voltage of the third voltage level applied to the second electrode up to a fourth voltage level during the application of the falling ramp voltage to the first electrode, wherein the falling ramp voltage starts before the fourth voltage level is applied to the second electrode.

5. The method of claim 4, wherein the third voltage level is lower than the second voltage level by a difference between a wall potential and a discharge triggering voltage.

6. The method of claim 5, wherein the wall potential is a difference between the first voltage level and the discharge triggering voltage.

7. The method of claim 5, wherein, during the application of the falling ramp voltage to the first electrode, the voltage applied to the second electrode is raised according to a rising ramp up to the fourth voltage level and is subsequently maintained thereto.

8. The method of claim 6, wherein, during the application of the falling ramp voltage to the first electrode, the voltage applied to the second electrode is raised according to a rising ramp up to the fourth voltage level and subsequently maintained thereto.

9. A plasma display device, comprising:

a plasma panel comprising:

an address electrode;

pair of a first electrode and a second electrode aligned substantially perpendicularly with the address electrode; and a discharge cell formed at crossing of the address electrode and the pair of the first electrode and the second electrode;

a controller for receiving video signals and for generating an addressing signal, a first driving signal for the first electrode and a second driving signal for the second electrode;

an address driver for receiving the addressing signal from the controller and for applying a data signal to the address electrode for selecting the discharge cell;

a first electrode driver for receiving the first driving signal from the controller and for applying a voltage to the first electrode of the selected discharge cell in order to induce a discharge; and a second electrode driver for receiving the second driving signal from the controller and for applying a voltage to the second electrode of the selected discharge cell in order to induce a discharge, wherein, during a reset period of the plasma panel, the first electrode driver applies a rising ramp voltage up to a first voltage level to the first electrode, the first electrode driver maintains the first electrode at a second voltage level that is lower than the first voltage level, and the second electrode driver increases a voltage applied to the second electrode to a third voltage level and then applies the voltage of the third voltage level to the second electrode while the first electrode driver maintains the first electrode at the second voltage level, the third voltage level being lower than the second voltage level.

10. The plasma display panel of claim 9, wherein the first electrode driver applies a falling ramp voltage to the first electrode after maintaining the first electrode to the second voltage level; and the second electrode driver, during the application of the falling ramp voltage to the first electrode, raises the voltage of the third voltage level applied to the second electrode according to a rising ramp up to the fourth voltage level and subsequently maintains the raised voltage.

11. The plasma display panel of claim 9, wherein the third voltage level is lower than the second voltage level by a difference between a wall potential and a discharge triggering voltage.

12. The plasma display panel of claim 10, wherein the third voltage level is lower than the second voltage level by a difference between a wall potential and a discharge triggering voltage.

13. The plasma display panel of claim 12, wherein the wall potential is a difference between the first voltage level and the discharge triggering voltage.

14. A method for driving a PDP, the PDP comprising a first electrode and a second electrode formed substantially in parallel on a first substrate, and an address electrode formed on a second substrate substantially perpendicularly to the first electrode and the second electrode, the method comprising:

during a reset period, applying a rising ramp voltage up to a first voltage level to the first electrode and then maintaining the first electrode at a second voltage level that is lower than the first voltage level;

applying a voltage of a third voltage level to the second electrode while maintaining the first electrode at the second voltage level, the third voltage level being lower than the second voltage level;

applying a falling ramp voltage to the first electrode after maintaining the first electrode at the second voltage level; and maintaining the address electrode at a fourth voltage level throughout the reset period.

15. The method of claim 14, wherein the third voltage level is lower than the second voltage level by a difference between a wall potential and a discharge triggering voltage.

16. The method of claim 15, wherein the wall potential is a difference between the first voltage level and the discharge triggering voltage.

17. The method of claim 14, further comprising raising the voltage of the third voltage level applied to the second electrode up to a fifth voltage level during the application of the falling ramp voltage to the first electrode.

18. The method of claim 17, wherein the third voltage level is lower than the second voltage level by a difference between a wall potential and a discharge triggering voltage.

19. The method of claim 18, wherein the wall potential is a difference between the first voltage level and the discharge triggering voltage.

20. The method of claim 18, wherein, during the application of the falling ramp voltage to the first electrode, the voltage applied to the second electrode is raised according to a rising ramp up to the fifth voltage level and is subsequently maintained thereto.

* * * * *